US009765976B2

(12) United States Patent
Daughtridge, Jr. et al.

(10) Patent No.: US 9,765,976 B2
(45) Date of Patent: Sep. 19, 2017

(54) DOMESTIC COOKING APPLIANCE WITH EMBOSSED LOCKING SYSTEM FOR A GAS FLUE

(71) Applicant: BSH Home Appliances Corporation, Irvine, CA (US)

(72) Inventors: Charles Daughtridge, Jr., New Bern, NC (US); Benjamin Knight, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 455 days.

(21) Appl. No.: 13/901,636

(22) Filed: May 24, 2013

(65) Prior Publication Data

US 2014/0345596 A1 Nov. 27, 2014

(51) Int. Cl.

| | |
|---|---|
| ***F23J 11/00*** | (2006.01) |
| ***F24C 15/00*** | (2006.01) |
| ***F24C 15/20*** | (2006.01) |
| ***F24C 3/00*** | (2006.01) |

(52) U.S. Cl.

CPC ..... *F24C 15/001* (2013.01); *F24C 3/00* (2013.01); *F24C 15/2007* (2013.01)

(58) Field of Classification Search

CPC ..... F24C 15/001; F24C 3/00; F24C 15/2007; B21C 37/10; F16L 1/10; F16L 3/1016; F16L 21/08; F16L 25/0009; F16L 25/0018; F16L 37/00; F16L 9/003; F16L 1/036;

(Continued)

(56) References Cited

U.S. PATENT DOCUMENTS

| | | | | |
|---|---|---|---|---|
| 2,054,703 A * | 9/1936 | Little | ..... | B21C 37/10 138/103 |
| 5,226,406 A * | 7/1993 | Reynolds | ..... | F24C 15/001 126/312 |
| 6,230,418 B1 | 5/2001 | Gomulinski | | |

(Continued)

FOREIGN PATENT DOCUMENTS

| | | | | |
|---|---|---|---|---|
| AU | 570237 B2 | 11/1984 | | |
| DE | 102005044376 A1 * | 3/2007 | ..... | B21C 37/10 |

(Continued)

OTHER PUBLICATIONS

Mi-Flues, MF3 S/W Flue Systems, Online: Mi-Flues.com, accessed Jan. 3, 2013, publication date unknown.

*Primary Examiner* — Jason Lau

(74) *Attorney, Agent, or Firm* — Michael E. Tschupp; Andre Pallapies

(57) ABSTRACT

A domestic cooking appliance is provided. The appliance has an inner space for cooking a food item; a gas burner; an exhaust opening; and a gas flue for directing exhaust gases from the inner space to the exhaust opening. The gas flue has a first part having a plurality of embossed projections, and a first fastener hole; and a second part that attaches to the first part, the second part having a plurality of embossed recesses that engage the plurality of embossed projections, and a second fastener hole that aligns with the first fastener hole when the first part and the second part are in an assembled position. The first part and the second part form a first tubular flue section when they are attached to each other, and the first part has more embossed projections than it does fastener holes.

25 Claims, 6 Drawing Sheets

(58) Field of Classification Search
CPC ..... F16L 19/00; F16L 37/08; B29C 65/58; B29C 66/1222
USPC ..... 126/312
See application file for complete search history.

(56) References Cited

U.S. PATENT DOCUMENTS

| | | | | |
|---|---|---|---|---|
| 6,761,159 | B1 * | 7/2004 | Barnes | F24C 15/2007 126/15 R |
| 8,429,803 | B2 * | 4/2013 | Coughenour | F24F 13/0209 29/451 |
| 2006/0243221 | A1 | 11/2006 | Moskwa | |
| 2008/0028592 | A1 * | 2/2008 | Stieler | B29C 65/3656 29/447 |

FOREIGN PATENT DOCUMENTS

| | | | |
|---|---|---|---|
| EP | 1528319 | A1 | 5/2005 |
| FR | 2714687 | A1 | 7/1995 |

* cited by examiner

DOMESTIC COOKING APPLIANCE WITH EMBOSSED LOCKING SYSTEM FOR A GAS FLUE

FIELD OF THE INVENTION

The invention is directed to a domestic cooking appliance having a gas flue that is assembled using an embossed locking system.

An example of an application for the invention is a domestic oven that uses gas for heating an inner space and has a flue that routs exhaust gasses out of the inner space.

BACKGROUND OF THE INVENTION

Some domestic cooking appliances have an inner space that receives a food item for heating. The heating can be done by, for example, electrical heating element or the burning of a gas fuel. In the case of heating with a gas fuel, the burnt exhaust gases, or other hot gases, sometimes need to be exhausted from the inner space.

In some such domestic cooking appliances, a flue or other exhaust conduit is provided to guide the exhaust or other hot gases from the inner space to one or more exhaust openings in the domestic cooking appliance. Often such a flue is constructed from multiple sheet metal pieces that are screwed or riveted together using many screws or rivets. Such a construction is time-consuming and expensive because it requires an assembler to locate and install the many screws or rivets while holding the multiple pieces in the correct position. The many screws or rivets also increases the chance of dropping one of the screws or rivets into the domestic cooking appliance during assembly.

In light of the above, there is a need for a system that quickly, easily, and precisely locates the parts of the flue relative to each other and locks the parts of the flue together using as few separate fasteners as possible.

SUMMARY

The invention achieves the benefit of providing a simple and cost effective system for assembling and fastening flue pieces to each other.

This benefit is achieved by providing embossed projections and corresponding embossed recesses on the various pieces of the flue so that the pieces can be snapped together and held in the proper relative position while one, or just a few, screws, rivets, or other fasteners are installed.

Particular embodiments of the invention are directed to a domestic cooking appliance having an inner space for cooking a food item. The domestic cooking appliance includes a gas burner that burns a fuel gas to produce heat inside the inner space of the domestic cooking appliance; an exhaust opening for exhausting exhaust gases from the inner space of the domestic cooking appliance; and a first gas flue for directing the exhaust gases from the inner space to the exhaust opening. The first gas flue has a first part having a plurality of embossed projections, and a first fastener hole; a second part that attaches to the first part, the second part having a plurality of embossed recesses that engage the plurality of embossed projections, and a second fastener hole that aligns with the first fastener hole when the first part and the second part are in an assembled position; and a fastener that extends through the first fastener hole and the second fastener hole and fastens the first part to the second part. The first part and the second part form a first tubular flue section when they are attached to each other, and the first part has more embossed projections than it does fastener holes.

Other embodiments of the invention are directed to a gas flue for a domestic cooking appliance, the domestic cooking appliance having an inner space for cooking a food item, a gas burner that burns a fuel gas to produce heat inside the inner space of the domestic cooking appliance, and an exhaust opening for exhausting exhaust gases from the inner space of the domestic cooking appliance. The gas flue includes a first part having a plurality of embossed projections, and a first fastener hole; a second part that attaches to the first part, the second part having a plurality of embossed recesses that engage the plurality of embossed projections, and a second fastener hole that aligns with the first fastener hole when the first part and the second part are in an assembled position; and a fastener that extends through the first fastener hole and the second fastener hole and fastens the first part to the second part. The first part and the second part form a first tubular flue section when they are attached to each other, the first part has more embossed projections than it does fastener holes, and the gas flue directs the exhaust gases from the inner space to the exhaust opening of the domestic cooking appliance.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As explained above, some domestic kitchens include a cooking appliance that has an inner space that receives a food item for cooking and this inner space is heated by burning a gas fuel. This burnt gas fuel, and other hot gases, often need to be exhausted from the inner space by way of a flue.

The drawings show an example of the invention that includes a gas flue having four major pieces that, when assembled, form a tubular duct for guiding the exhaust gases to an exhaust opening in the domestic cooking appliance.

Figure 1:
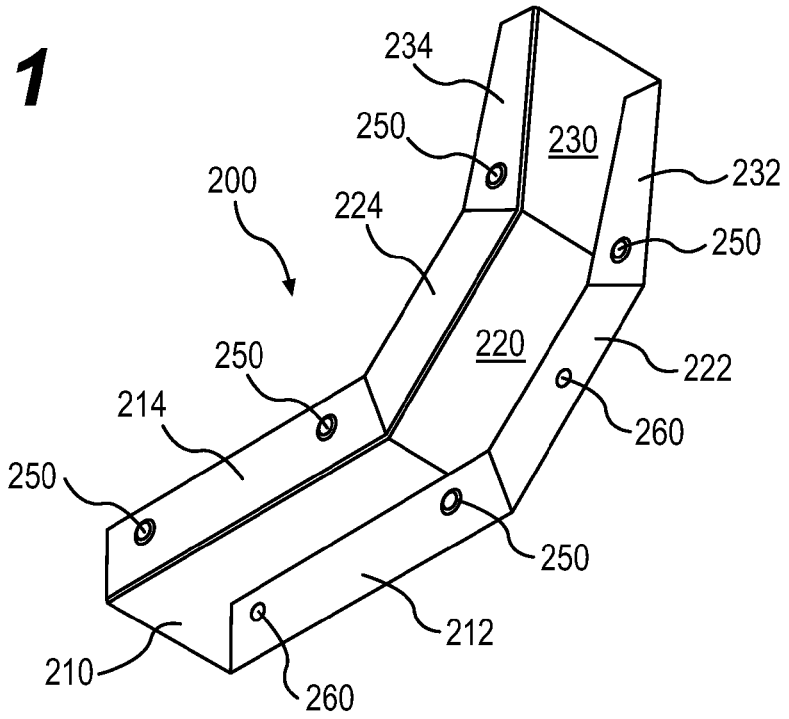
FIG. 1 is a perspective view of an example of a first part of a gas flue for a domestic cooking appliance in accordance with exemplary embodiments of the invention.
Figure 3:
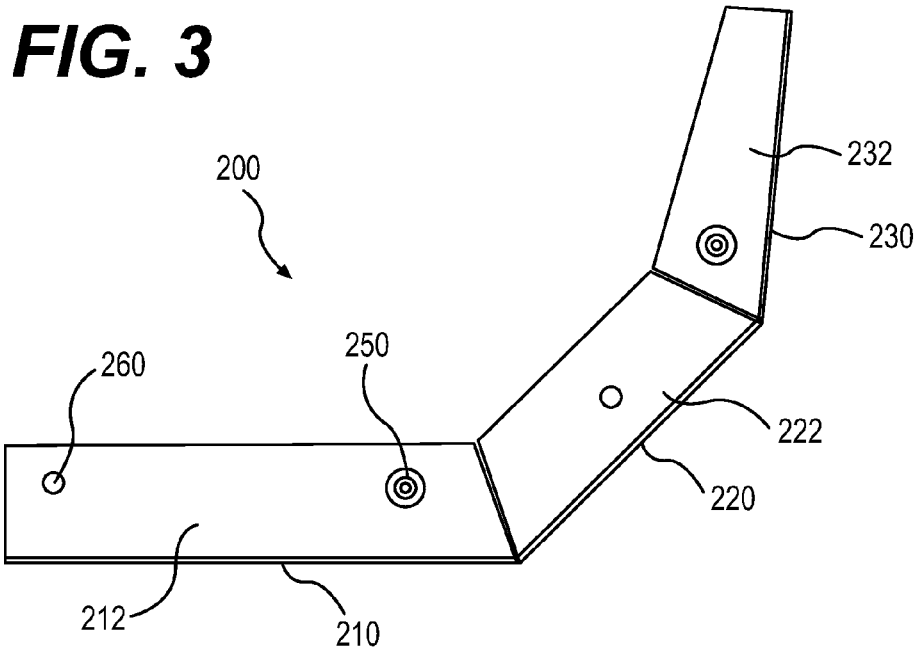
FIG. 3 is a side view of the first part shown in FIG. 1.
Figure 4:
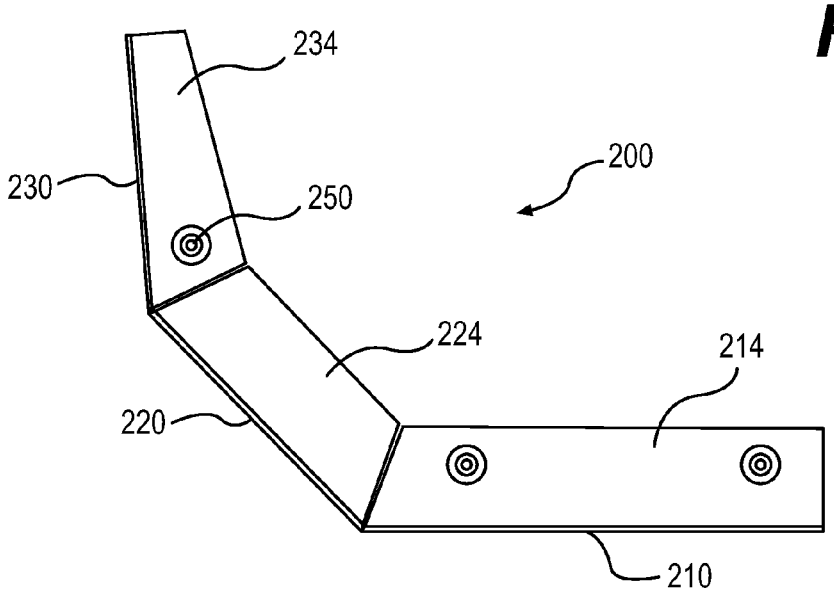
FIG. 4 is a side view of the first part shown in FIG. 1.

FIGS. 1, 3 and 4 show a first piece 200 that has a horizontal section 210, a vertical section 230, and a transition section 220 that connects horizontal section 210 and vertical section 230. In this exemplary description, "vertical" and "horizontal" are used for clarity to describe particular pieces, but it is noted that the invention is not limited to these orientations. In this example, horizontal section 210 has side pieces 212, 214 that extend at right angles from horizontal section 210. Similarly, transition section 220 has side pieces 222, 224 that extend at right angles from transition section 220; and vertical section 230 has side pieces 232, 234 that extend at right angles from vertical section 230. Although the various side pieces extend at right angles in this example, other angles can also be used.

Figure 2:
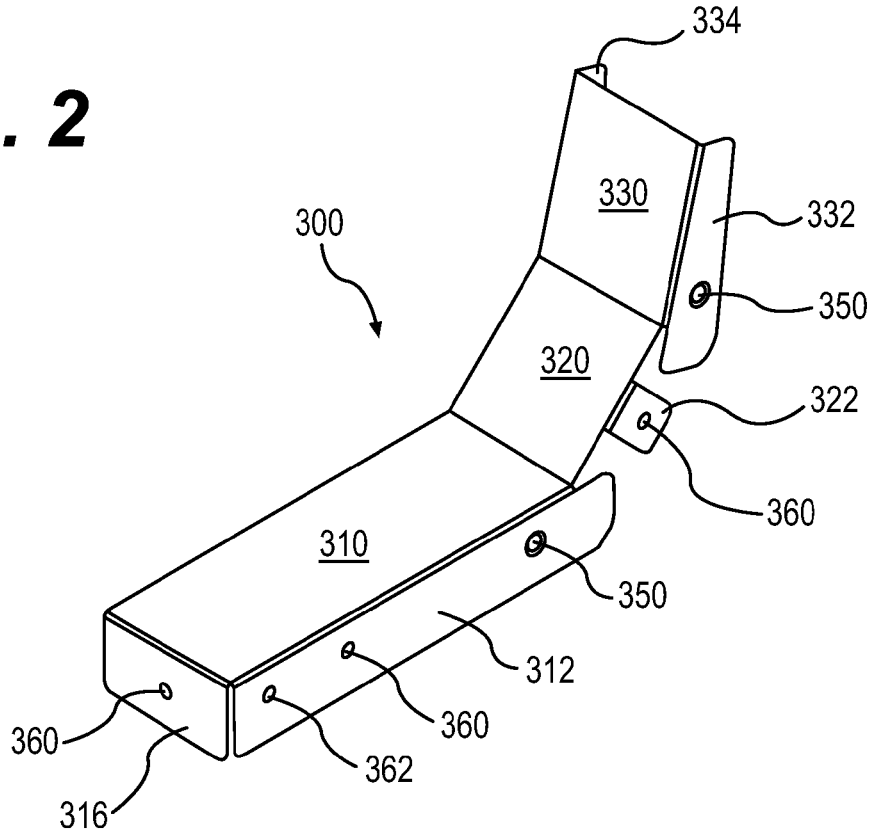
FIG. 2 is a perspective view of an example of a second part of a gas flue for a domestic cooking appliance in accordance with exemplary embodiments of the invention.
Figure 5:
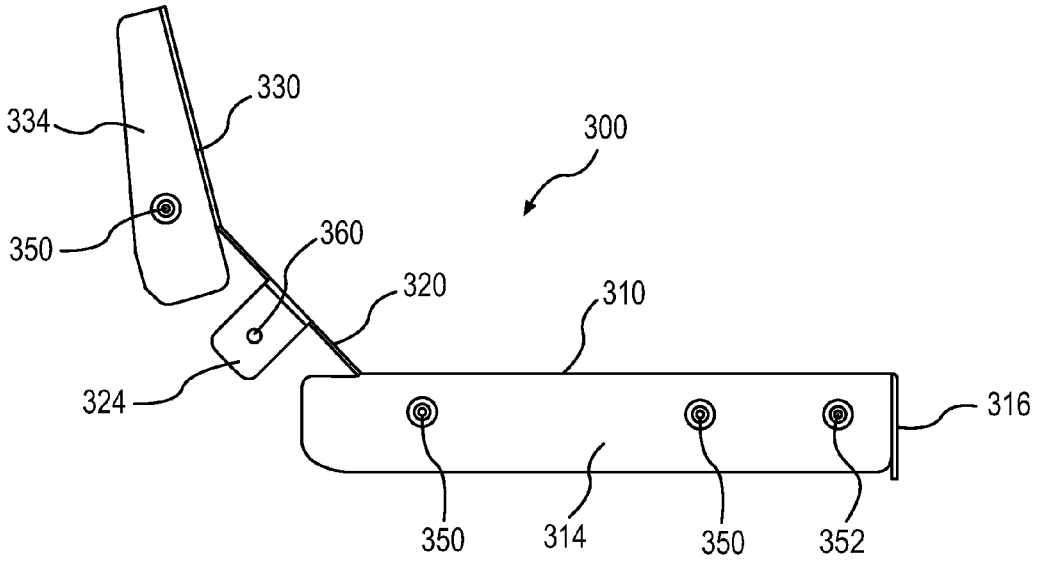
FIG. 5 is a side view of the second part shown in FIG. 2.
Figure 6:
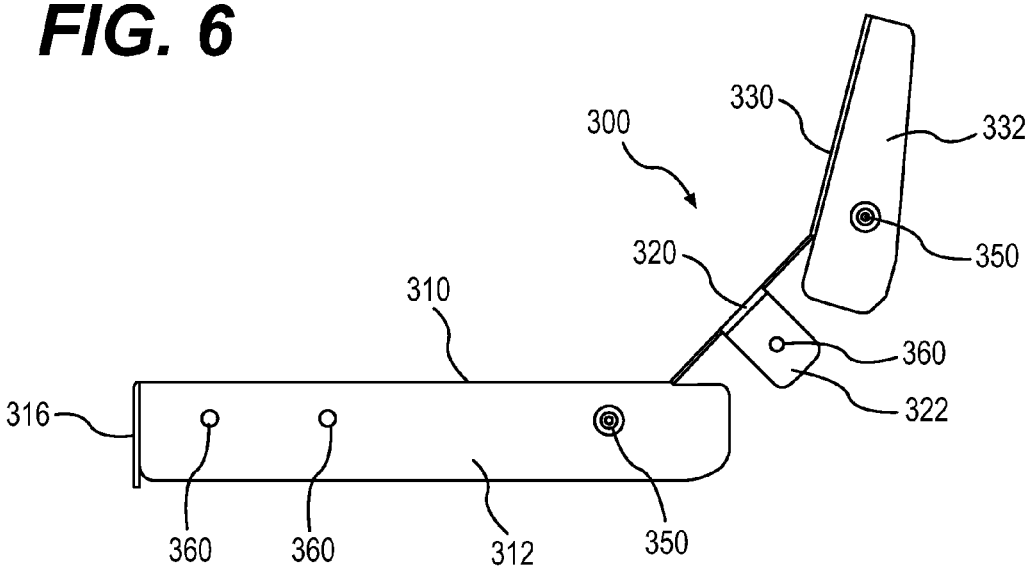
FIG. 6 is a side view of the second part shown in FIG. 2.

FIGS. 2, 5 and 6 show a second piece 300 that has a horizontal section 310, a vertical section 330, and a transition section 320 that connects horizontal section 310 and vertical section 330. Again, in this exemplary description, "vertical" and "horizontal" are used for clarity to describe particular pieces, but it is noted that the invention is not limited to these orientations. In this example, horizontal section 310 has side pieces 312, 314 that extend at right angles from horizontal section 310. Similarly, transition section 320 has side tabs 322, 324 that extend at right angles from transition section 320; and vertical section 330 has side pieces 332, 334 that extend at right angles from vertical section 330. Although the various side pieces and tabs extend at right angles in this example, other angles can also be used.

Figure 9:
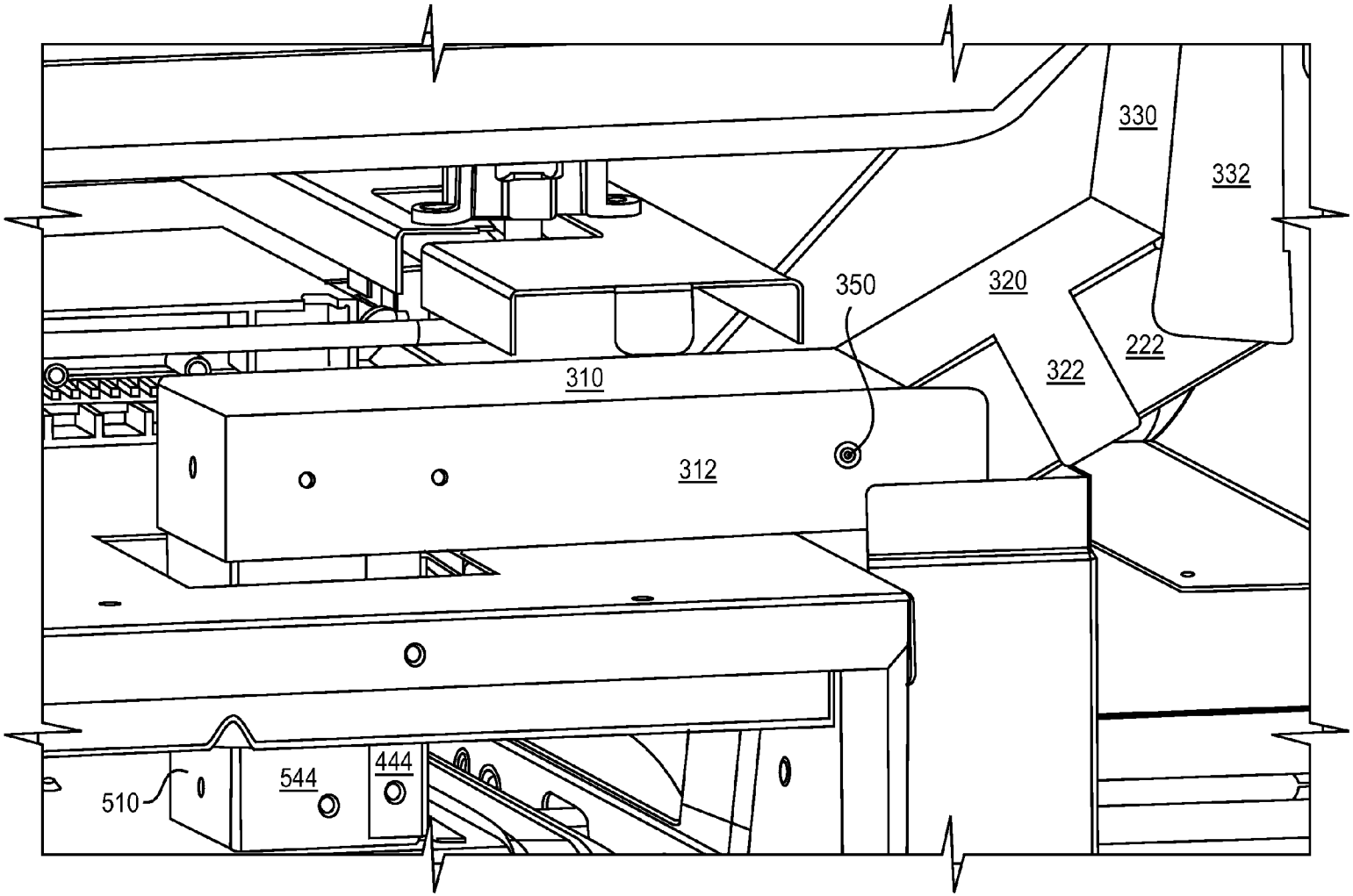
FIG. 9 is a partial perspective and sectional view of an example of a domestic cooking appliance in accordance with exemplary embodiments of the invention.

First piece 200 and second piece 300 attach to each other and resultant in a first tubular section of a flue that is shown in FIG. 9.

Figure 7:
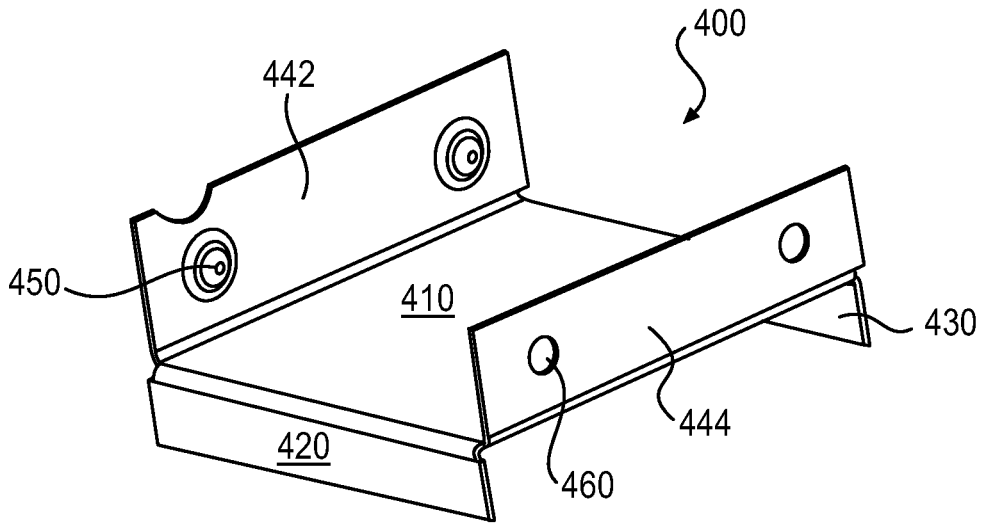
FIG. 7 is a perspective view of an example of a third part of a gas flue for a domestic cooking appliance in accordance with exemplary embodiments of the invention.
Figure 8:
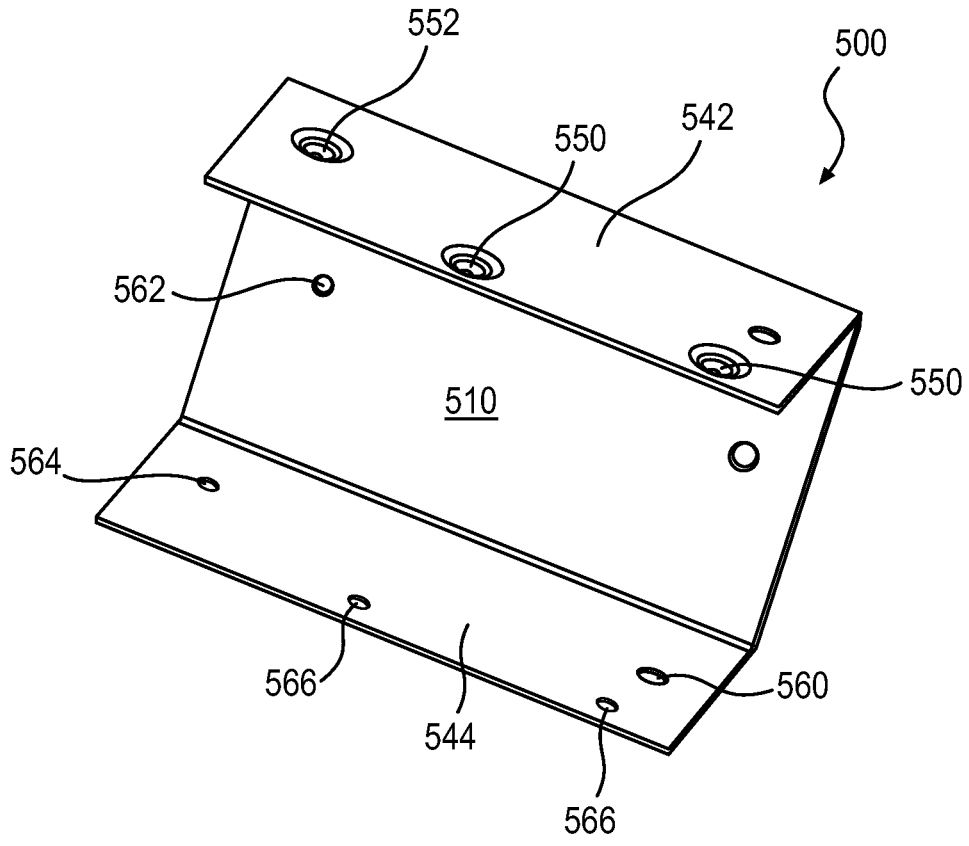
FIG. 8 is a perspective view of an example of a fourth part of a gas flue for a domestic cooking appliance in accordance with exemplary embodiments of the invention.

FIGS. 7 and 8 show two more pieces of the exemplary flue shown in FIG. 9. FIG. 7 shows a third piece 400 that has a vertical section 410 (that is vertical in the installed orientation shown in FIG. 9) that has side pieces 442, 444 that extend at right angles from vertical section 410. Third piece 400 also has two tabs 420, 430 that extend at right angles from vertical section 410. FIG. 8 shows a fourth piece 500 that has a vertical section 510 (that is vertical in the installed orientation shown in FIG. 9) that has side pieces 542, 544 that extend at right angles from vertical section 510. Although the various side pieces and tabs extend at right angles in this example, other angles can also be used. As can be seen in FIG. 9, third piece 400 and fourth piece 500 attached to each other and result in a second tubular section of the flue.

As also shown in FIG. 9, an upper end of the second tubular section (formed by third piece 400 and fourth piece 500) is received in an end of the first tubular section (formed by first piece 200 and second piece 300).

Figure 10:
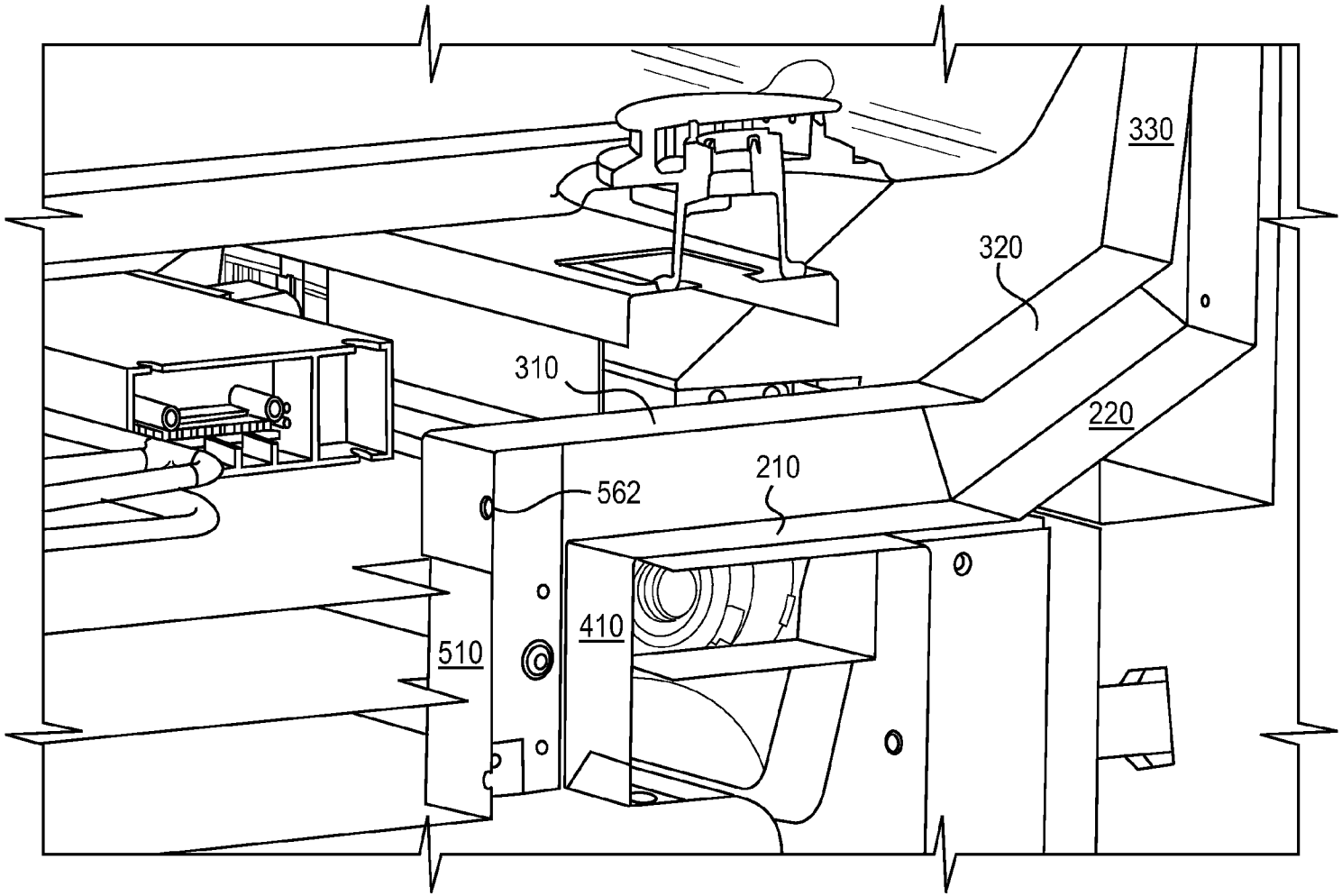
FIG. 10 is a partial perspective and sectional view of an example of a domestic cooking appliance in accordance with exemplary embodiments of the invention.

FIG. 10 shows a sectional view the flue that clearly shows the interaction between the first and second tubular sections. Also shown in FIG. 10 is a plurality of exhaust openings in the domestic cooking appliance that are located at an upper and of the flue and to which exhaust gases are channeled by the flue. The lower end of the flue opens into the inner space of the domestic cooking appliance where a food item is heated. This configuration results in the flue forming a tubular conduit between the inner space and the exhaust openings. While this example shows one flue, it is recognize that two or more similar or identical flues can be used in a single domestic cooking appliance. For example, FIGS. 9 and 10 show a flue offset to the right of center in a domestic cooking appliance that has an identical flue offset an identical amount to the left of center. FIGS. 9 and 10 also show gas burners that are part of a cook top of the domestic cooking appliance. The gas burners and cook top are located above the majority of the flue, and in front of the exhaust outlets.

As shown in the Figures, the various pieces of the flue have embossed projections, embossed recesses, and fastening holes that interact with embossed recesses, embossed projections, and fastening holes of others of the various pieces.

For example, FIG. 2 shows multiple embossed projections 350 that project toward an inside of second piece 300. FIG. 1 shows multiple embossed recesses 250 that receive embossed projections 350. When second piece 300 is attached to first piece 200, embossed projections 350 engage embossed recesses 250 to hold first piece 200 and second piece 300 in the correct position relative to each other while screws, rivets, or other fasteners are inserted through fastening holes 260, 360 to secure second piece 300 to first piece 200. While this example shows first piece 200 having embossed recesses and second piece 300 having embossed projections, it is noted that other examples of the invention provide embossed projections on first piece 200 and embossed recesses on second piece 300 or a combination of the two.

FIG. 7 shows third piece 400 having on side piece 442 two embossed projections 450 that extend inward. FIG. 8 shows two embossed recesses 550 that correspond to and receive embossed projections 450. FIG. 8 also shows a third embossed recess 552 that receives an embossed projection 352 of second piece 300 (shown in FIG. 5). When fourth piece 500 is attached to the third piece 400, embossed projections 450 engage embossed recesses 550 to hold third piece 400 and fourth piece 500 in the correct position relative to each other while screws, rivets, or other fasteners are inserted through fastening holes 460, 566 to secure fourth piece 500 to third piece 400. Fastening hole 564 aligns with fastening hole 362 on second piece 300 so that a fastener can be inserted into fastening hole 362 and fastening hole 564 to attach fourth piece 500 to second piece 300.

The above exemplary structure provides, through the use of a plurality of embossed projections and embossed recesses, a simple and effective way to securely assemble a gas flue by holding the various pieces of the gas flue in their correct relative positions while a small number of fasteners are installed.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the invention.

What is claimed is:

1. A domestic cooking appliance having an inner space for cooking a food item, comprising:

a gas burner that burns a fuel gas to produce heat inside the inner space of the domestic cooking appliance;

an exhaust opening for exhausting exhaust gases from the inner space of the domestic cooking appliance; and a first gas flue for directing the exhaust gases from the inner space to the exhaust opening, the first gas flue having a first part having at least one first section with at least one first side piece, a plurality of embossed projections on the at least one first side piece, and a first fastener hole on the at least one first side piece, a second part that attaches to the first part, the second part having at least one second section with at least one second side piece, a plurality of embossed recesses on the at least one second side piece that engage the plurality of embossed projections, and a second fastener hole on the at least one second side piece that aligns with the first fastener hole when the first part and the second part are in an assembled position, and a fastener that extends through the first fastener hole and the second fastener hole and fastens the first part to the second part, wherein the first part and the second part form a first tubular flue section when they are attached to each other, and the first part has more embossed projections than it does fastener holes.

2. The domestic cooking appliance of claim 1, wherein the first part has no more than two fastener holes.

3. The domestic cooking appliance of claim 2, wherein the second part has no more than two fastener holes.

4. The domestic cooking appliance of claim 1, further comprising a second gas flue for directing the exhaust gases from the inner space to a second exhaust opening, the second gas flue having a first part of the second gas flue having a plurality of embossed projections, and a first fastener hole, a second part of the second gas flue that attaches to the first part of the second gas flue, the second part of the second gas flue having a plurality of embossed recesses that engage the plurality of embossed projections of the first part of the second gas flue, and a second fastener hole that aligns with the first fastener hole of the first part of the second gas flue when the first part of the second gas flue and the second part of the second gas flue are in an assembled position, and a fastener that extends through the first fastener hole of the first part of the second gas flue and the second fastener hole of the second part of the second gas flue and fastens the first part of the second gas flue to the second part of the second gas flue, wherein the first part of the second gas flue and the second part of the second gas flue form a first tubular flue section of the second gas flue when they are attached to each other, and the first part of the second gas flue has more embossed projections than it does fastener holes.

5. The domestic cooking appliance of claim 4, wherein the first part of the second gas flue has no more than two fastener holes.

6. The domestic cooking appliance of claim 1, wherein the first gas flue further comprises a third part having a second plurality of embossed projections, and a fourth part that attaches to the third part, the fourth part having a second plurality of embossed recesses that engage the second plurality of embossed projections, wherein the third part and the fourth part form a second tubular flue section when they are attached to each other, and the fourth part has an embossed projection or embossed recess that engages an embossed recess or embossed projection of the second part.

7. The domestic cooking appliance of claim 6, wherein the first tubular flue section and the second tubular flue section form one continuous tubular flue.

8. The domestic cooking appliance of claim 7, wherein exhaust opening is located at a rear upper area of the domestic cooking appliance.

9. The domestic cooking appliance of claim 1, wherein exhaust opening is located at a rear upper area of the domestic cooking appliance.

10. The domestic cooking appliance of claim 6, wherein the first tubular flue section and the second tubular flue section are located above the inner space of the domestic cooking appliance.

11. The domestic cooking appliance of claim 10, further comprising a cook top burner, wherein at least a portion of the first tubular flue section is located below the cook top burner.

12. The domestic cooking appliance of claim 1, wherein the first tubular flue section is located above the inner space the domestic cooking appliance.

13. The domestic cooking appliance of claim 12, further comprising a cook top burner, wherein at least a portion of the first tubular flue section is located below the cook top burner.

14. A gas flue for a domestic cooking appliance, the domestic cooking appliance having an inner space for cooking a food item, a gas burner that burns a fuel gas to produce heat inside the inner space of the domestic cooking appliance, and an exhaust opening for exhausting exhaust gases from the inner space of the domestic cooking appliance, the gas flue comprising:

a first part having at least one first section with at least one first side piece, a plurality of embossed projections on the at least one first side piece, and a first fastener hole on the at least one first side piece, a second part that attaches to the first part, the second part having at least one second section with at least one second side piece, a plurality of embossed recesses on the at least one second side that engage the plurality of embossed projections, and a second fastener hole on the at least one second side piece that aligns with the first fastener hole when the first part and the second part are in an assembled position, and a fastener that extends through the first fastener hole and the second fastener hole and fastens the first part to the second part, wherein the first part and the second part form a first tubular flue section when they are attached to each other, the first part has more embossed projections than it does fastener holes, and the gas flue directs the exhaust gases from the inner space to the exhaust opening of the domestic cooking appliance.

15. The gas flue of claim 14, wherein the first part has no more than two fastener holes.

16. The gas flue of claim 15, wherein the second part has no more than two fastener holes.

17. The gas flue of claim 14, wherein the gas flue further comprises a third part having a second plurality of embossed projections, and a fourth part that attaches to the third part, the fourth part having a second plurality of embossed recesses that engage the second plurality of embossed projections, wherein the third part and the fourth part form a second tubular flue section when they are attached to each other, and the fourth part has an embossed projection or embossed recess that engages an embossed recess or embossed projection of the second part.

18. The gas flue of claim 17, wherein the first tubular flue section and the second tubular flue section form one continuous tubular flue.

19. The gas flue of claim 14, wherein the plurality of embossed recesses engaging the plurality of embossed projections prevents movement of the first part relative to the second part.

20. The gas flue of claim 14, wherein the plurality of embossed recesses engage the plurality of embossed projections in only on relative position of the first part and the second part.

21. The gas flue of claim 14, wherein the first part attaches to the second part in only on position when the plurality of embossed recesses engage the plurality of embossed projections.

22. The domestic cooking appliance of claim 1, wherein the plurality of embossed recesses engaging the plurality of embossed projections prevents movement of the first part relative to the second part.

23. The domestic cooking appliance of claim 1, wherein the plurality of embossed recesses engage the plurality of embossed projections in only on relative position of the first part and the second part.

24. The domestic cooking appliance of claim 1, wherein the first part attaches to the second part in only on position when the plurality of embossed recesses engage the plurality of embossed projections.

25. A gas flue for a domestic cooking appliance, the domestic cooking appliance having an inner space for cooking a food item, a gas burner that burns a fuel gas to produce heat inside the inner space of the domestic cooking appliance, and an exhaust opening for exhausting exhaust gases from the inner space of the domestic cooking appliance, the gas flue comprising:

a first part having a plurality of first sections, each of the first sections having a plurality of first side pieces extending from each of the first sections, a plurality of embossed projections located on the first side pieces, and a first fastener hole located on at least one of the first side pieces, a second part that attaches to the first part, the second part having a plurality of second sections, each of the second sections having a plurality of second side pieces extending from each of the second sections, a plurality of embossed recesses located on the second side pieces, and a second fastener hole located on at least one of the second side pieces, wherein the plurality of first side pieces and the plurality of second side pieces overlap and the first fastener hole and the second fastener hole align when the first part and the second part are attached, and a fastener that extends through the first fastener hole and the second fastener hole and fastens the first part to the second part, wherein the first part and the second part form a first tubular flue section when they are attached to each other, and the gas flue directs the exhaust gases from the inner space to the exhaust opening of the domestic cooking appliance.

* * * * *